US009269517B2

(12) United States Patent
Huang et al.

(10) Patent No.: US 9,269,517 B2
(45) Date of Patent: Feb. 23, 2016

(54) KIND OF ANTI-ADHESION DEVICE, A HEATING APPARATUS INCLUDING THE DEVICE, AND METHOD OF OPERATING THE SAME

(75) Inventors: Xiankun Huang, Nanjing (CN); Yousheng Tang, Nanjing (CN); Degang Liu, Nanjing (CN); Guobin Yang, Nanjing (CN); Fanghua Chen, Nanjing (CN)

(73) Assignee: A.O. SMITH CORPORATION, Milwaukee, WI (US)

( * ) Notice: Subject to any disclaimer, the term of this patent is extended or adjusted under 35 U.S.C. 154(b) by 365 days.

(21) Appl. No.: 13/606,613

(22) Filed: Sep. 7, 2012

(65) Prior Publication Data

US 2013/0062330 A1 Mar. 14, 2013

(30) Foreign Application Priority Data

Sep. 8, 2011 (CN) ..... 2011 2 0336128 U

(51) Int. Cl.
*H05B 3/00* (2006.01)
*H05B 3/02* (2006.01)
*H01H 47/00* (2006.01)

(52) U.S. Cl.
CPC ..... *H01H 47/002* (2013.01); *H01H 2047/003* (2013.01)

(58) Field of Classification Search
CPC ..... H01H 2047/003; H01H 47/002; H01L 23/34–23/345; F24H 9/2007–9/2028; F24H 1/185; F24H 1/20–1/201; H02J 3/14; H05B 1/0283–1/0286
USPC ..... 219/482, 483, 476, 477, 507, 509, 219/443.1–438.2
See application file for complete search history.

(56) References Cited

U.S. PATENT DOCUMENTS

| | | | | |
|---|---|---|---|---|
| 4,369,776 | A * | 1/1983 | Roberts | 128/200.14 |
| 5,006,932 | A * | 4/1991 | Bergstrom et al. | 348/502 |
| 5,504,306 | A * | 4/1996 | Russell et al. | 219/497 |
| 5,808,277 | A * | 9/1998 | Dosani et al. | 219/481 |
| 7,209,651 | B1 * | 4/2007 | Knoeppel et al. | 392/451 |
| 7,221,862 | B1 * | 5/2007 | Miller et al. | 392/498 |

FOREIGN PATENT DOCUMENTS

| | | |
|---|---|---|
| CN | 201897339 | 7/2011 |
| CN | 202259040 | 5/2012 |

* cited by examiner

*Primary Examiner* — Sang Y Paik
(74) *Attorney, Agent, or Firm* — Michael Best & Friedrich LLP

(57) ABSTRACT

A kind of anti-adhesion device for a relay. The device can include a control circuit and adhesion detecting circuit of first and second relays, which are used to respectively control power on and power off of the first and second electric heater. Closing a switch of the control circuit of the first and second relays is used to lead out the line and the output elements of the adhesion detecting circuit, to form a detecting loop. An interlocking circuit is bridged between the control circuit of the first and second relay. Therefore the first and second relay won't be closed at the same time, to avoid the fault caused by parallel connection of electric heaters. The adhesion detecting circuit can output a square wave when a relay has adhesion. The square wave avoids mixing with a low level output of the detecting circuit.

9 Claims, 2 Drawing Sheets

KIND OF ANTI-ADHESION DEVICE, A HEATING APPARATUS INCLUDING THE DEVICE, AND METHOD OF OPERATING THE SAME

RELATED APPLICATIONS

This application claims priority to Chinese Utility Model No. 201120336128.7, filed Sep. 8, 2011, the contents of which are incorporated herein by reference.

BACKGROUND

The invention relates to a detecting control device that may be used for an electric heater circuit, especially a kind of anti-adhesion device for a relay, which belongs to detecting control circuit technology.

A relay can be used to control the heating element of a water heater. Because the relay is used to control a big current loop, serious failures endanger the application of the water heater. Exemplary failures include continuous heating, parallel connection of heating elements, and current overload caused due to invalid adhesion of the relay (e.g., lack of operation or ON at all times). It was found through search that Chinese Patent ZL201020604497.5 discloses a kind of anti-adhesion technical scheme for a relay, which is of the function of relay adhesion detection, but with its own defects: when judged whether the relay is adhered according to the detecting signal is low level or not, the circumstances such as detecting circuit failure hasn't been considered, because no judgment will be made under this condition, so as to influence the stability of the whole detection system. Additionally, the function of adhesion detection and interlocking control of the relay can't be realized simultaneously in this technical scheme.

SUMMARY

In one embodiment, the invention provides a kind of stable and reliable anti-adhesion device for a relay with the function of relay interlock aiming at the existing technical defects. This device for a relay includes the control circuit and adhesion detecting circuit of a first relay and a second relay, which is used to respectively control power on and power off of a first electric heater and a second electric heater. An interlocking circuit is also contained. Closing a switch of the control circuit of the first relay and the second relay is used to lead out the line and the output elements of the adhesion detecting circuit, to form a detecting loop. And the interlocking circuit is bridged between the control circuit of the first relay and the second relay.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
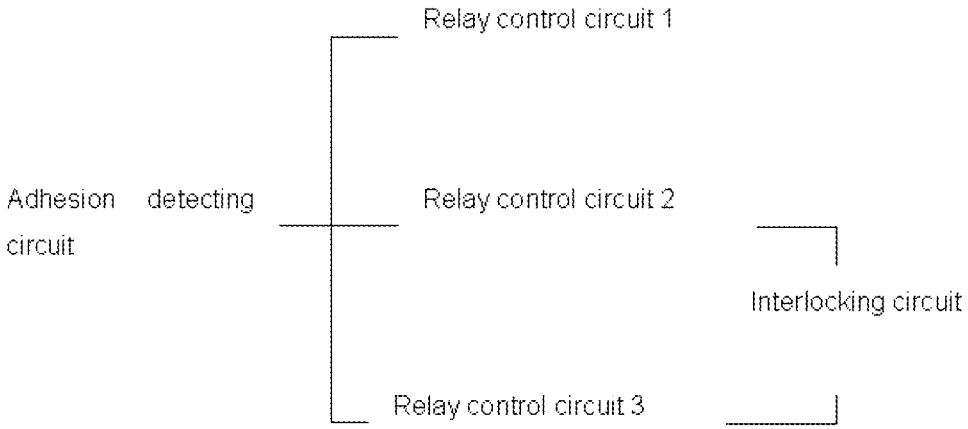
FIG. 1 shows a block diagram of one embodiment of the invention.
Figure 2:
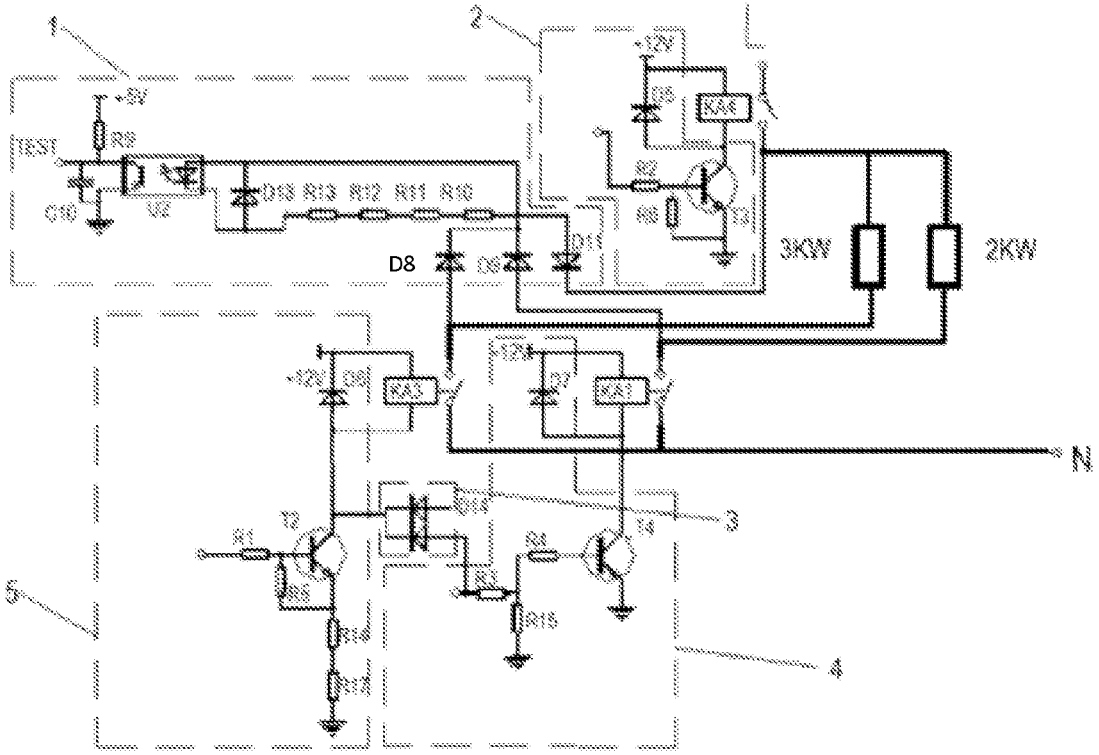
FIG. 2 shows a schematic circuit diagram of the embodiment of FIG. 1.

The embodiment of FIGS. 1 and 2 shows a kind of anti-adhesion device for a relay applied to an electric water heater. Refer to FIG. 1 for its basic structure, and refer to FIG. 2 for the specific circuit structure. Control circuit 5 and 4 (corresponding to relay control circuit 2 and relay control circuit 3 in FIG. 1) of the first relay KA3 and the second relay KA1 are used to control power on and power off of the first electric heating element and the second electric heating element. In addition, control circuit 2 (corresponding to relay control circuit 1 in FIG. 1) of the third relay KA4 also is provided to control parallel bus of the first and the second electric heating elements. Basic structure of various relay control circuits is the same, including the relay coils connected in the drive transistor collector. Collector of the drive transistor T2 in control circuit 5 of the first relay is connected to base resistor of the drive transistor T4 in control circuit 4 of the second relay through clamp diode D14, to form an interlocking circuit bridged between the control circuit of the first relay and the second relay. When the first relay KA3 closes, base level of the drive transistor T4 in control circuit of the second relay is locked below 0.7V via diode D14, to ensure the second relay KA1 does not close by mistake due to invalid procedure, so as to avoid the possibility of parallel operation of two heating elements. Adhesion detecting circuit 1 with optic coupling output TEST mainly is composed of a group of resistors, which is cascaded on the input end of optic coupling element U2. Relay closing switches of the control circuit of the first relay and the second relay, respectively, lead out the optic coupling elements of the line and adhesion detecting circuit, to form a detecting loop. When relay KA4, KA3 or KA1 closes, detecting circuits (D8, D9, D11, R10, R11, R12, R13 and U2) form a loop between AC, N, and L. A square wave signal with the same frequency as AC power will be output from output end (TEST) of optic coupling element U2.

Failures and their damages of the above relays are shown as: 1) relay KA1 or KA3 or KA4 can't close, leading to that the water heater is heated for a long time and its temperature can't rise, with little damage; 2) relay KA1 or KA3 adheres, leading to that the water heater can't stop heating or parallel heating and current overload to the heating elements, resulting in damage.

The following can be realized by virtue of the logic circuit due to the adhesion detecting circuit.

1. Before the water heater is heated, all relays are out of operation. If the detecting circuit is damaged, then low level signal can be detected.
2. The water heater begins to heat. Firstly close the bus relay (KA4), if relay KA1 or KA3 adheres, a square wave signal is detected. To control and output the related alarm signal, then turn off all relays. If the circuit is normal, high level will be detected. At this time, KA1 or KA3 can be chosen to close, making it work normally.
3. During heating (after KA4, KA1 or KA3 is closed), if the detecting circuit or the control loop of the relay is damaged, a square wave can't be detected, then control and output the related alarm signal.
4. The water heater stops heating, firstly open KA4. If it adheres, then a square wave will be detected. Next, control and output the related alarm signal, and turn off all relays. If the circuit is normal, then a high level will be detected. At this time, KA1 or KA3 can be opened.

In this embodiment, whether the relay is adhered can be judged from whether there is square wave signal detected, which is free from the outside voltage. Various failures of the relays can be detected, with low cost.

Besides the above embodiments, other manners can be executed for this invention. The technical schemes formed on the basis of equivalent replacement or transformation will be within the protection scope required by this invention.

Thus, the invention provides, among other things, a new and useful kind of anti-adhesion device and a water heater including the device. Various features and advantages of the invention are set forth in the following claims.

What is claimed is:

1. A heating apparatus comprising: a first heating element; a second heating element; a first relay controlling current through the first heating element; a second relay controlling current through the second heating element; a first relay control circuit controlling the first relay; a second relay control circuit controlling the second relay; a third, bus relay further controlling current through the first heating element and the second heating element; a third relay control circuit controlling the third, bus relay; an adhesion detecting circuit coupled to the first relay, the second relay, and the third, bus relay, the adhesion detecting circuit being configured to receive an output from the first control circuit, receive a second output from the second control circuit, receive a third output from the third control circuit, and provide an alarm signal based on the first output, the second output, and the third output.

2. The heating apparatus of claim 1, further comprising an interlocking circuit coupling the first relay control circuit with the second relay control circuit.

3. The heating apparatus of claim 2, wherein the first control circuit includes a first transistor and the second control circuit includes a second transistor, wherein the interlocking circuit couples a collector of the first transistor to a base of the second transistor.

4. The heating apparatus of claim 3, wherein the interlocking circuit is configured to prevent the second control circuit from closing the second relay in response to the first relay being closed.

5. The heating apparatus of claim 1, wherein the adhesion detecting circuit includes a current loop controlled by the first output, the second output, and the third output.

6. The heating apparatus of claim 5, wherein the adhesion detecting circuit includes an optic coupling element connected in circuit of the current loop, and wherein the optic coupling element is configured to provide a fourth output when a current flows through the loop.

7. An anti-adhesion device for a relay, the device comprising:

a first control circuit for powering a first relay, the first control circuit including a first switch operable to close the first relay;

a second control circuit for powering a second relay, the second control circuit including a second switch operable to close the second relay;

an adhesion detecting circuit including an optic coupling device having a first end and a second end, the first end electrically connected to the first relay and the second relay, the second end electrically connected to an output for generating an alarm signal; and an interlocking circuit coupling the first control circuit with the second control circuit;

wherein closing at least one selected from the group consisting of the first relay and the second relay leads out a respective line to the adhesion detecting circuit forming a detecting loop.

8. The device according to claim 7, further comprising a third control circuit for powering a third relay to control power on and power off of a parallel bus to the first relay and the second relay.

9. The device according to claim 7, wherein the first switch includes a collector connected to a base of the second switch via the interlocking circuit.

* * * * *